US012253085B2

(12) United States Patent
Kojima

(10) Patent No.: US 12,253,085 B2
(45) Date of Patent: Mar. 18, 2025

(54) COMPRESSOR

(71) Applicant: DAIKIN INDUSTRIES, LTD., Osaka (JP)

(72) Inventor: Makoto Kojima, Osaka (JP)

(73) Assignee: DAIKIN INDUSTRIES, LTD., OSAKA (JP)

( * ) Notice: Subject to any disclaimer, the term of this patent is extended or adjusted under 35 U.S.C. 154(b) by 189 days.

(21) Appl. No.: 17/585,280

(22) Filed: Jan. 26, 2022

(65) Prior Publication Data

US 2022/0145889 A1 May 12, 2022

Related U.S. Application Data

(63) Continuation of application No. PCT/JP2020/028828, filed on Jul. 28, 2020.

(30) Foreign Application Priority Data

Jul. 29, 2019 (JP) ..... 2019-138902

(51) Int. Cl.
*F04C 29/02* (2006.01)
*F04B 39/02* (2006.01)
*F04C 23/02* (2006.01)

(52) U.S. Cl.
CPC ..... *F04C 29/02* (2013.01); *F04B 39/02* (2013.01); *F04B 39/023* (2013.01);
(Continued)

(58) Field of Classification Search
CPC ..... F04C 29/02; F04C 29/021; F04C 23/02; F04C 2240/30; F04C 18/356;
(Continued)

(56) References Cited

U.S. PATENT DOCUMENTS

2014/0056727 A1* 2/2014 Koyama ..... F04C 18/0215 417/228
2016/0186754 A1* 6/2016 Cho ..... F04C 29/023 418/55.1

FOREIGN PATENT DOCUMENTS

CN 103635696 A 3/2014
CN 108591064 A 9/2018
(Continued)

OTHER PUBLICATIONS

Raw machine translation of CN108591064 (A); "Compressor, air conditioner and control method of compressor "; Zhang et al.; Sep. 29, 2018.*

(Continued)

*Primary Examiner* — Charles G Freay
*Assistant Examiner* — Lilya Pekarskaya
(74) *Attorney, Agent, or Firm* — GLOBAL IP COUNSELORS, LLP

(57) ABSTRACT

A compressor includes a casing that stores a lubrication oil in a bottom portion, a compression mechanism disposed in the casing, an electric motor disposed above the compression mechanism, a discharge pipe opening in a space in the casing on an upper side of the motor, and an oil drainage mechanism that guides a lubrication oil adhering to an inner wall of the casing to the discharge pipe using a swirling flow generated by rotation of the motor. The oil drainage mechanism includes an oil drain pipe having one end opening in the inner wall of the casing and another end connected to the discharge pipe, and a flow-rate regulating valve disposed at the oil drain pipe. The flow-rate regulating valve has a changeable opening degree. The opening degree of the flow-rate regulating valve is configured to be regulated in accordance with a rotational speed of the motor.

4 Claims, 8 Drawing Sheets

(52) U.S. Cl.
CPC ..... *F04B 39/0238* (2013.01); *F04C 29/021* (2013.01); *F04C 23/02* (2013.01); *F04C 2240/30* (2013.01)

(58) Field of Classification Search
CPC .... F04C 23/008; F04C 29/025; F04C 29/026; F04B 39/02; F04B 39/023; F04B 39/0238; F04B 39/0261
See application file for complete search history.

(56) References Cited

FOREIGN PATENT DOCUMENTS

| | | | | |
|---|---|---|---|---|
| EP | 3 194 783 | A1 | | 7/2017 |
| JP | 2006-329067 | A | | 12/2006 |
| JP | 2011-179456 | A | | 9/2011 |
| JP | 2014-118863 | A | | 6/2014 |
| JP | 2015-34536 | A | | 2/2015 |
| JP | 2015-105638 | A | | 6/2015 |
| JP | 2018040372 | A | * | 3/2018 |

OTHER PUBLICATIONS

Raw machine translation of JP2011179456 (A); "Compressor"; Fukatsu Shingo; Sep. 15, 2011.*
Raw machine translation of P2018040372 (A) ; "Compressor "; Azuma et al.; Mar. 15, 2018.*
International Preliminary Report of corresponding PCT Application No. PCT/JP2020/028828 dated Feb. 10, 2022.
International Search Report of corresponding PCT Application No. PCT/JP2020/028828 dated Sep. 8, 2020.
European Search Report of corresponding EP Application No. 20 84 7525.1 dated Jul. 21, 2022.

* cited by examiner

COMPRESSOR

CROSS-REFERENCE TO RELATED APPLICATIONS

This is a continuation of International Application No. PCT/JP2020/028828 filed on Jul. 28, 2020, which claims priority to Japanese Patent Application No. 2019-138902, filed on Jul. 29, 2019. The entire disclosures of these applications are incorporated by reference herein.

BACKGROUND

Field of Invention

The present disclosure relates to a compressor.

Background Information

A compressor that is used for an air conditioning apparatus or the like has been known. The compressor compresses and discharges a sucked fluid (for example, a refrigerant). Japanese Unexamined Patent Application Publication No. 2014-118863 discloses a rotary compressor including a casing configured to store a lubrication oil in a bottom portion thereof; a motor (electric motor) housed in the casing and mounted on a drive shaft; and a compression mechanism provided below the motor in the casing and configured to compress and discharge a sucked refrigerant into the casing. In the compressor, a discharge pipe with which the inside and the outside of the casing are in communication with each other is provided to extend through an upper part of the casing. The refrigerant discharged into the casing is drained from the discharge pipe to the outside of the casing.

SUMMARY

A first aspect of the present disclosure is a compressor that includes a casing configured to store a lubrication oil in a bottom portion thereof, a compression mechanism disposed in the casing, an electric motor disposed above the compression mechanism, a discharge pipe opening in a space in the casing on an upper side of the electric motor, and an oil drainage mechanism configured to guide a lubrication oil adhering to an inner wall of the casing to the discharge pipe using a swirling flow generated by rotation of the electric motor. The compression mechanism is configured to compress a sucked fluid. The electric motor is configured to drive the compression mechanism. The oil drainage mechanism includes an oil drain pipe having one end opening in the inner wall of the casing and another end connected to the discharge pipe, and a flow-rate regulating valve disposed at the oil drain pipe. The flow-rate regulating valve has a changeable opening degree. The opening degree of the flow-rate regulating valve is configured to be regulated in accordance with a rotational speed of the electric motor.

DETAILED DESCRIPTION OF EMBODIMENT(S)

Embodiment 1

Embodiment 1 will be described.

Refrigeration Apparatus

Figure 1:
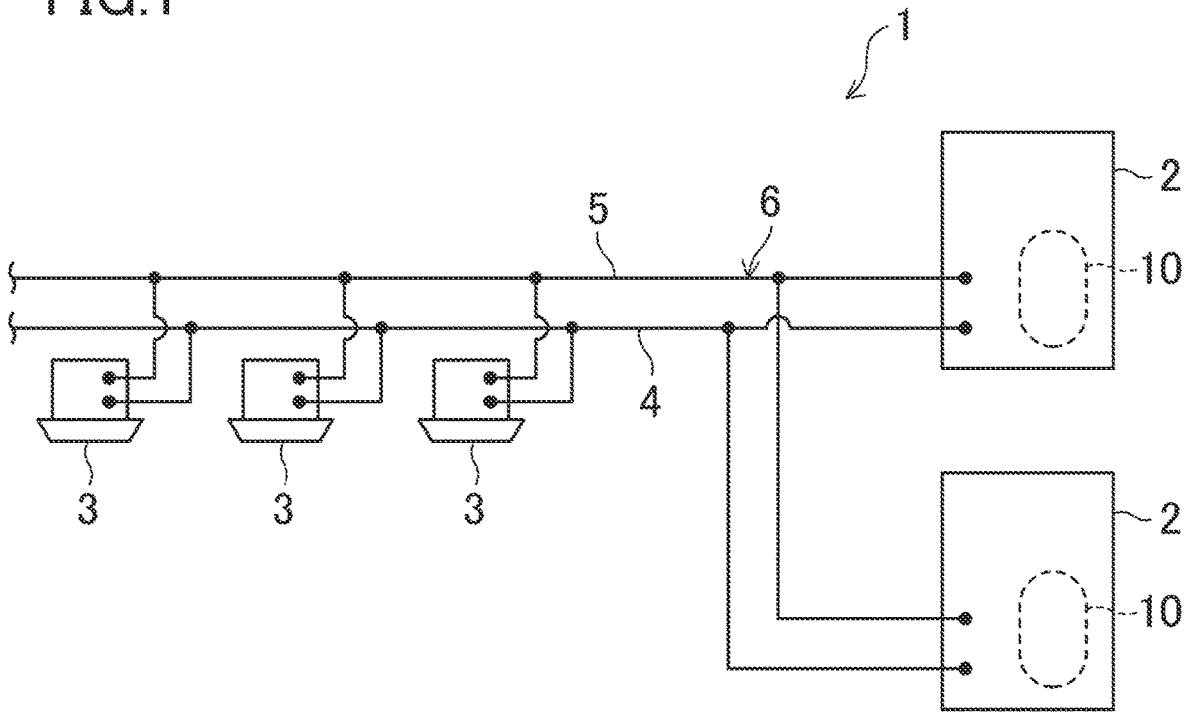
FIG. 1 is a view schematically illustrating a configuration of a refrigeration apparatus according to Embodiment 1.

First, a refrigeration apparatus (1) provided with a compressor (10) according to the present embodiment will be described. The refrigeration apparatus (1) is an air conditioning apparatus that performs cooling and heating of the inside of a room. As illustrated in FIG. 1, the refrigeration apparatus (1) includes a plurality of outdoor units (2) and a plurality of indoor units (3). The compressor (10) according to the present embodiment is provided at each of the outdoor units (2). The outdoor units (2) and the indoor units (3) are connected to each other via a liquid-side connection pipe (4) and a gas-side connection pipe (5) and constitute a refrigerant circuit (6). In the refrigerant circuit (6), the plurality of outdoor units (2) are connected in parallel to each other, and the plurality of indoor units (3) are connected in parallel to each other.

Compressor

Figure 2:
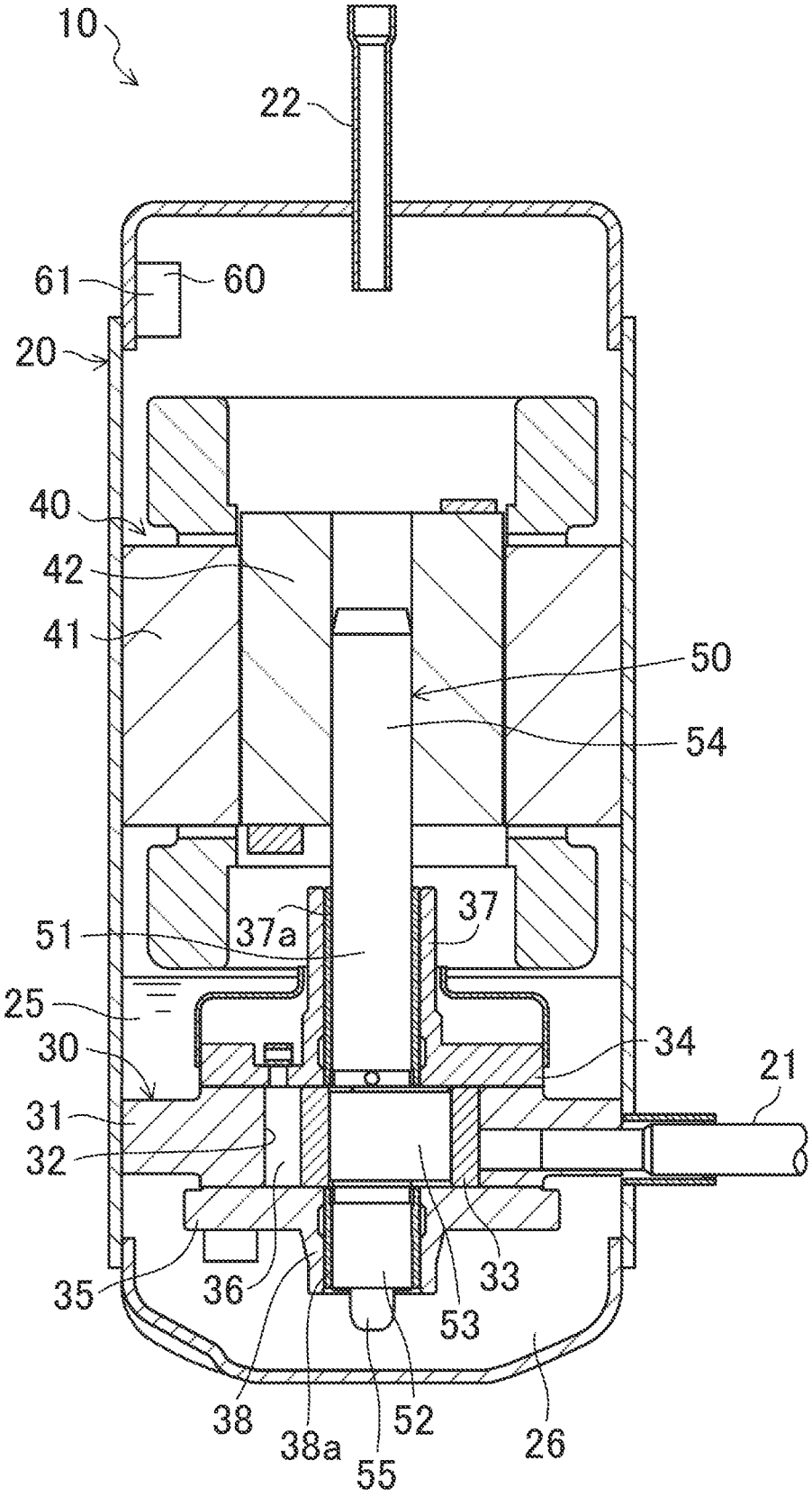
FIG. 2 is a longitudinal sectional view of a compressor (rotary compressor) according to Embodiment 1.

As illustrated in FIG. 2, the compressor (10) is a rotary full-hermetic compressor. The compressor (10) includes a casing (20), a compression mechanism (30), an electric motor (40), and a drive shaft (50). The compression mechanism (30), the electric motor (40), and the drive shaft (50) are accommodated in the casing (20).

Casing

The casing (20) is a cylindrical airtight container closed at both ends. The axial direction of the casing (20) is the up-down direction. In the internal space of the casing (20), the electric motor (40) is disposed above the compression mechanism (30). The casing (20) includes a suction pipe (21) and a discharge pipe (22). The suction pipe (21) extends through a barrel portion of the casing (20) and is connected to the compression mechanism (30). The discharge pipe (22) extends through a top portion of the casing (20). The discharge pipe (22) opens in a space in the inside of the casing (20) on the upper side of the electric motor (40). The discharge pipe (22) opens in a center portion of the casing (20). In the present embodiment, the discharge pipe (22) is a straight pipe. An oil storage portion (26) for storing a lubrication oil (25) that is to be supplied to each sliding part of the compression mechanism (30) and the like is formed in a bottom portion of the casing (20).

Compression Mechanism

The compression mechanism (30) is a rotary fluid machinery of a so-called swing piston type. The compression mechanism (30) is for compressing a sucked fluid. The compression mechanism (30) includes a cylinder (31), a piston (33), a front head (34), and a rear head (35).

The cylinder (31) is a thick disc-shaped member having a cylinder bore (32) at the center thereof. The thick cylindrical piston (33) is disposed at the cylinder bore (32). An eccentric shaft portion (53) of a drive shaft (50), which will be described later, is inserted into the piston (33). In the compression mechanism (30), a compression chamber (36) is formed between the wall surface of the cylinder bore (32) and the outer peripheral surface of the piston (33). Although not illustrated, the compression mechanism (30) is provided with a blade that partitions the compression chamber (36) into a high-pressure chamber and a low-pressure chamber.

The front head (34) is a plate-shaped member that closes the upper end surface of the cylinder (31). At a center portion of the front head (34), a cylindrical main bearing portion (37) is formed. A bearing metal (37*a*) is fitted to the main bearing portion (37). The main bearing portion (37) having the bearing metal (37*a*) is a sliding bearing that supports the drive shaft (50). The rear head (35) is a plate-shaped member that closes the lower end surface of the cylinder (31). At a center portion of the rear head (35), a cylindrical sub-bearing portion (38) is formed. A bearing metal (38*a*) is fitted to the sub-bearing portion (38). The sub-bearing portion (38) having the bearing metal (38*a*) is a sliding bearing that supports the drive shaft (50).

Electric Motor

The electric motor (40) is for driving the compression mechanism (30) via the drive shaft (50), which will be described later. The electric motor (40) is provided above the compression mechanism (30).

The electric motor (40) includes a stator (41) and a rotor (42). The stator (41) is fixed to a barrel portion of the casing (20). The rotor (42) is disposed on the inner side of the stator (41). The drive shaft (50) is inserted into the rotor (42).

Drive Shaft

The drive shaft (50) includes a main journal portion (51), a sub journal portion (52), the eccentric shaft portion (53), and an upper shaft portion (54). In the drive shaft (50), the sub journal portion (52), the eccentric shaft portion (53), the main journal portion (51), and the upper shaft portion (54) are disposed in this order from the lower end toward the upper end of the drive shaft (50).

The main journal portion (51), the sub journal portion (52), and the upper shaft portion (54) each have a columnar shape and are disposed coaxially. The main journal portion (51) is inserted into the main bearing portion (37) of the front head (34). The sub journal portion (52) is inserted into the sub-bearing portion (38) of the rear head (35). In the drive shaft (50), the main journal portion (51) is supported by the main bearing portion (37), and the sub journal portion (52) is supported by the sub-bearing portion (38). The upper shaft portion (54) is inserted into the rotor (42) of the electric motor (40). The rotor (42) is fixed to the upper shaft portion (54).

The eccentric shaft portion (53) has a columnar shape having a diameter larger than the diameters of the main journal portion (51) and the sub journal portion (52). The shaft center of the eccentric shaft portion (53) is substantially parallel to the shaft centers of the main journal portion (51) and the sub journal portion (52) and is eccentric to the shaft centers of the main journal portion (51) and the sub journal portion (52). The eccentric shaft portion (53) is inserted into the piston (33). The eccentric shaft portion (53) is a journal portion that supports the piston (33).

A centrifugal pump (55) immersed at the oil storage portion (26) is provided at the lower end of the sub journal portion (52). Although illustration is omitted, an oil supply passage is formed in the drive shaft (50). The oil supply passage is a passage for supplying the lubrication oil (25) (refrigerating-machine oil) stored in a bottom portion of the casing (20) to sliding portions. When the drive shaft (50) rotates, the lubrication oil (25) in the oil storage portion (26) is pumped up by the centrifugal pump (55) to the oil supply passage in the drive shaft (50). The lubrication oil (25) is supplied through the oil supply passage to sliding portions between the drive shaft (50) and each of the main bearing portion (37), the sub-bearing portion (38), and the piston (33).

Oil Drainage Mechanism

An oil drainage mechanism (60) guides the lubrication oil (25) adhering to the inner wall of the casing (20) to the discharge pipe (22) by using the swirling flow of the refrigerant and the lubrication oil (25) generated in the casing (20) by the rotation of the electric motor (40). In the present embodiment, the oil drainage mechanism (60) is a projection (61).

Figure 3:
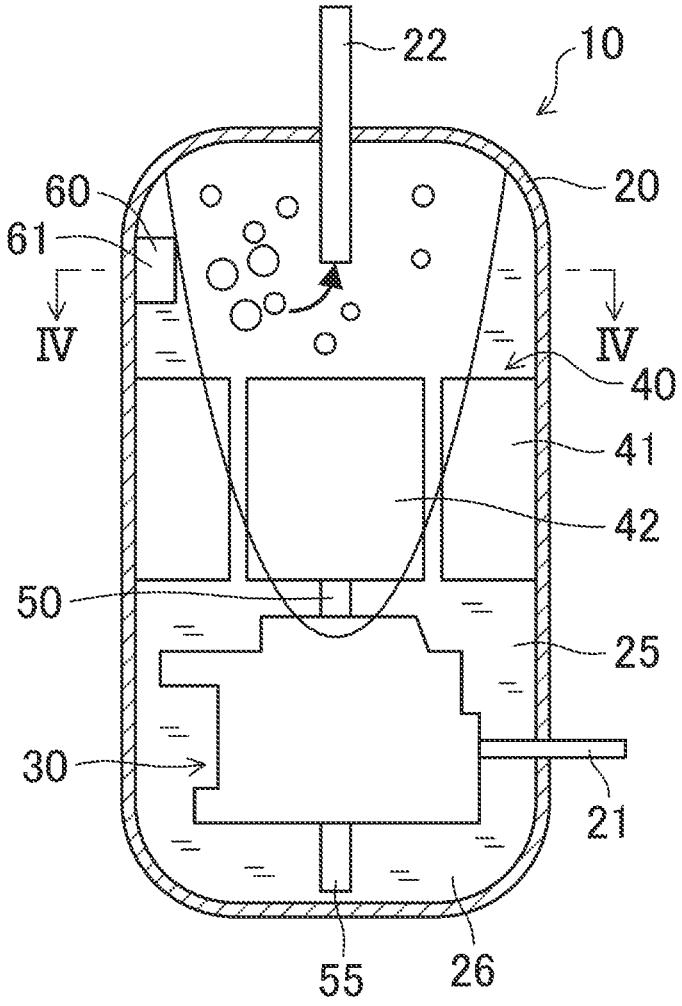
FIG. 3 is a schematic longitudinal sectional view illustrating the flow of a lubrication oil in the compressor according to Embodiment 1.
Figure 4:
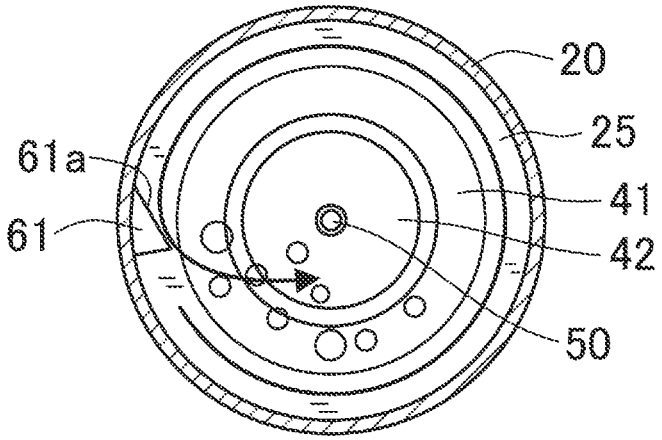
FIG. 4 is a sectional view along line IV-IV in the direction of the arrows in FIG. 3.

As illustrated in FIG. 3 and FIG. 4, the projection (61) projects from the inner wall on the upper side of the electric motor (40) in the casing (20). The projection (61) has generally a triangular prism shape. The height direction of the projection (61) is the up-down direction.

The projection (61) has a guide surface (61*a*) that is a concave surface. The guide surface (61*a*) is a surface of the projection (61) facing a swirling direction of the swirling flow. The guide surface (61*a*) is inclined to approach the center side of the casing (20) as advancing in the swirling direction of the swirling flow. The guide surface (61*a*) is formed to guide the lubrication oil (25) adhering to the inner wall of the casing (20) to the center side of the casing (20). Specifically, the guide surface (61*a*) separates the lubrication oil (25) swirling while adhering to the inner wall of the casing (20) from the inner wall and guides the lubrication oil (25) toward the discharge pipe (22) opening in a center portion of the casing (20).

Flow of Lubrication Oil

Next, the flow of the lubrication oil (25) in the casing (20) will be described.

When the electric motor (40) is driven, and the drive shaft (50) rotates, the compression mechanism (30) is activated. When the compression mechanism (30) is activated, the swirling flow of the refrigerant and the lubrication oil (25) stored in the casing (20) is generated. As illustrated in FIG. 3, when the swirling flow is generated, a centrifugal force acts on the lubrication oil (25) and causes the lubrication oil (25) to be in a state of adhering to the inner wall of the casing (20). The shape of the oil surface becomes a concave surface shape that becomes higher toward the inner wall. As illustrated in FIG. 4, when the lubrication oil (25) adhering to the inner wall reaches an upper portion of the casing (20), the lubrication oil (25) hits the guide surface (61*a*) of the projection (61) and jumps up to be separated from the inner wall. The separated lubrication oil (25) flows into the discharge pipe (22) together with a gas refrigerant that flows toward the discharge pipe (22). The oil that has flowed into the discharge pipe (22) passes through the inside of the discharge pipe (22) and flows out to the outside of the casing (20).

Feature (1) of Embodiment 1

In the present embodiment, the compressor (10) includes the casing (20) that stores a lubrication oil in a bottom portion thereof; the compression mechanism (30) that is provided in the casing (20) and compresses a sucked fluid; the electric motor (40) that is provided on the compression mechanism (30) and drives the compression mechanism (30); and the discharge pipe (22) that opens in a space in the casing (20) on the upper side of the electric motor (40). The compressor (10) includes the oil drainage mechanism (60) that guides the lubrication oil (25) adhering to the inner wall of the casing (20) to the discharge pipe (22) by using the swirling flow generated by the rotation of the electric motor (40).

Here, when a plurality of the compressors (10) are connected in parallel in the refrigerant circuit (6), the amount of the lubrication oil that returns to each of the compressor (10) may become uneven, and the lubrication oil may tend to be present in some of the compressors (10). At this time, when the amount of the lubrication oil drained from the compressors (10) that hold a large amount of the lubrication oil is small, the other compressors (10) may be continued to be in a state in which the holding amount of the lubrication oil is small and may lack the lubrication oil.

To cope with this, in the present embodiment, the lubrication oil (25) in the casing (20) is guided to the discharge pipe (22) by the oil drainage mechanism (60) that uses the swirling flow. It is thus possible to cause the lubrication oil (25) to flow out easily to the outside of the compressor (10). Consequently, even when a plurality of the compressors (10) are connected in parallel, it is possible to suppress uneven presence of the lubrication oil in the compressors (10).

Feature (2) of Embodiment 1

The oil drainage mechanism (60) of the compressor (10) according to the present embodiment is the projection (61) projecting from the inner wall of the casing (20) on the upper side of the electric motor (40).

Therefore, the lubrication oil (25) that has reached a space of the casing (20) on the upper side of the electric motor (40) due to the swirling flow hits the projection (61) and is guided to the discharge pipe (22). It is thus possible to cause the lubrication oil (25) to flow out easily to the outside of the compressor (10).

Feature (3) of Embodiment 1

The discharge pipe (22) of the compressor (10) according to the present embodiment opens in a center portion of the casing (20). The projection (61) of the compressor (10) has the guide surface (61*a*) that guides the lubrication oil (25) adhering to the inner wall of the casing (20) to the center side of the casing (20).

Therefore, when the lubrication oil (25) in the casing (20) hits the guide surface (61*a*) of the projection (61), the lubrication oil (25) jumps up toward the discharge pipe (22). Consequently, it is possible to cause the lubrication oil (25) to flow out easily to the outside of the compressor (10).

Modifications of Embodiment 1

Figure 5:
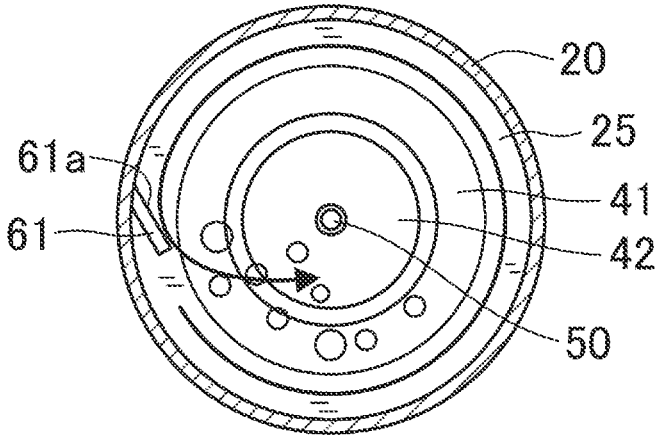
FIG. 5 corresponds to FIG. 4 and illustrates a modification of Embodiment 1.

As illustrated in FIG. 5, the projection (61) has a tabular shape in a modification of the present embodiment. The projection (61) is tilted to the inner wall side along the swirling direction of the swirling flow. Also in the tabular projection (61), a surface facing the swirling direction of the swirling flow is the guide surface (61*a*). The guide surface (61*a*) of the projection (61) is a flat surface.

Embodiment 2

Embodiment 2 will be described. The compressor (10) according to the present embodiment is the compressor (10) according to Embodiment 1 in which the oil drainage mechanism (60) is changed. The oil drainage mechanism (60) according to the present embodiment will be described here.

Oil Drainage Mechanism

Figure 6:
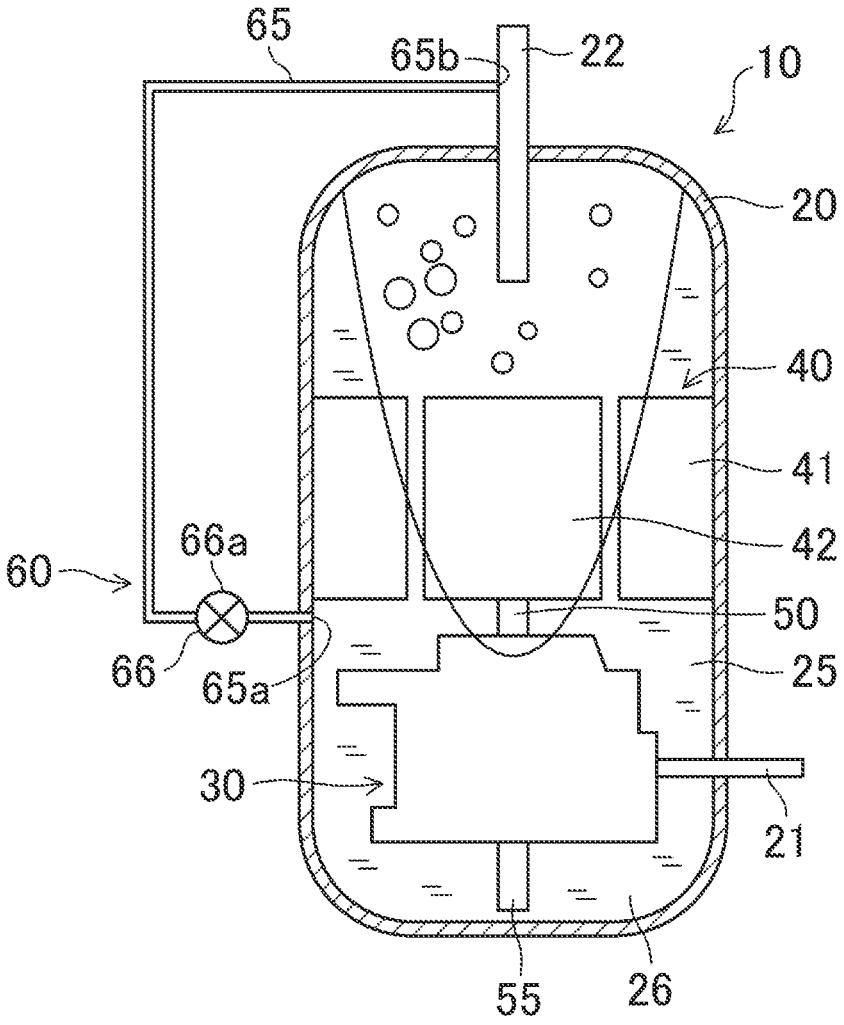
FIG. 6 corresponds to FIG. 3 and illustrates a compressor according to Embodiment 2.

As illustrated in FIG. 6, in the present embodiment, the oil drainage mechanism (60) includes an oil drain pipe (65) and a flow-rate regulating valve (66). The oil drain pipe (65) is provided at an outer portion of the casing (20). With the oil drain pipe (65), the inside of the casing (20) and the discharge pipe (22) are in communication with each other. Specifically, one end (65*a*) (inflow end) of the oil drain pipe (65) opens in the inner wall of the casing (20). The one end (65*a*) of the oil drain pipe (65) opens in the inner wall of the casing (20) below the electric motor (40). The one end (65*a*) of the oil drain pipe (65) opens in the inner wall of the casing (20) above the compression mechanism (30). In other words, the one end of the oil drain pipe (65) opens in the inner wall of the casing (20) between the compression mechanism (30) and the electric motor (40). Another end (65*b*) (outflow end) of the oil drain pipe (65) is connected to the discharge pipe (22). The oil drain pipe (65) is provided with a flow-rate regulating valve. In this example, an electric valve (66*a*) is provided as the flow-rate regulating valve. The opening degree of the electric valve (66*a*) is changeable.

Flow of Lubrication Oil

Next, the flow of the lubrication oil (25) in the casing will be described.

When the electric motor (40) is driven, and the drive shaft (50) rotates, the compression mechanism (30) is activated. When the compression mechanism (30) is activated, the swirling flow of the refrigerant and the lubrication oil (25) stored in the casing (20) is generated. As illustrated in FIG. 6, when the swirling flow is generated, a centrifugal force acts on the lubrication oil (25) and causes the lubrication oil (25) to be in a state of adhering to the inner wall of the casing (20). The shape of the oil surface becomes a concave surface shape that becomes higher toward the inner wall. The lubrication oil (25) adhering to the inner wall is pushed out into the oil drain pipe (65) through the inflow end (65*a*) of the oil drain pipe (65) by the action of the centrifugal force. The lubrication oil (25) that has flowed into the oil drain pipe (65) passes through the electric valve (66*a*) and is drained to the discharge pipe (22) through the outflow end (65*b*) of the oil drain pipe (65).

Figure 7A:
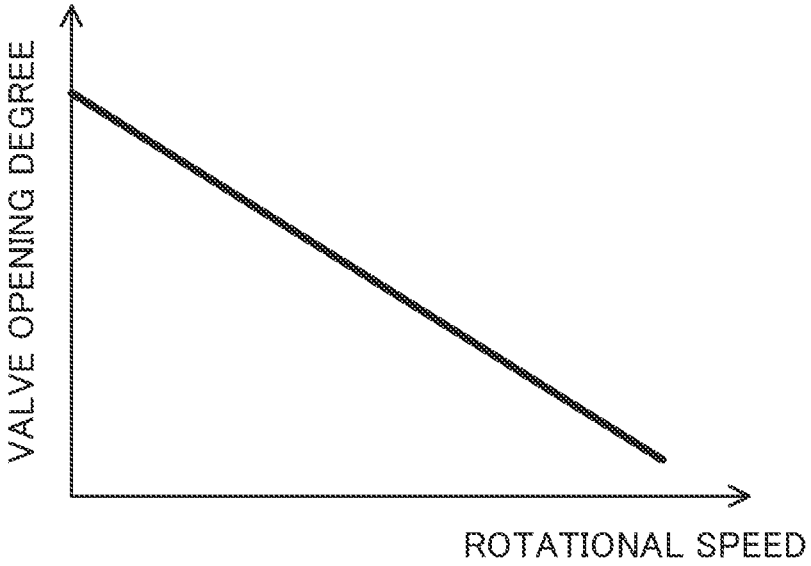
FIG. 7A is a graph illustrating a relation between rotational speed and the opening degree of a valve according to Embodiment 2.
Figure 7B:
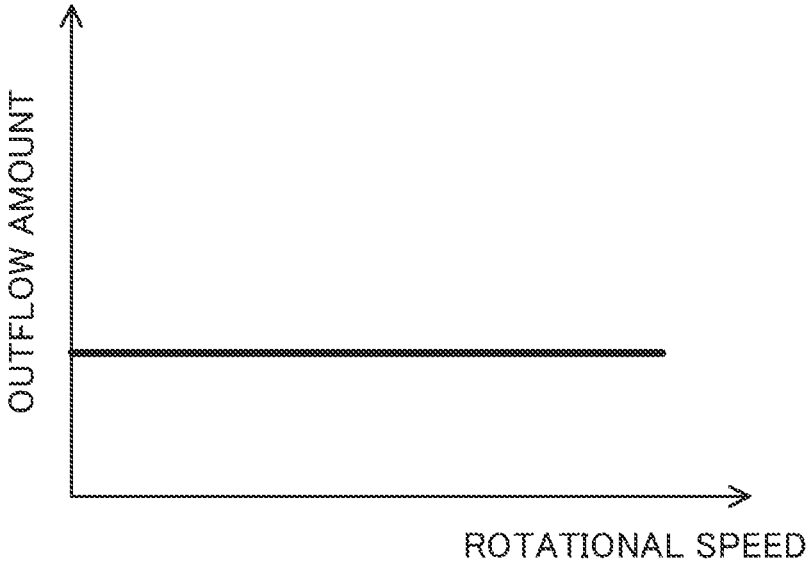
FIG. 7B is a graph illustrating a relation between rotational speed and the amount of a lubrication oil that flows out to the outside of a compressor according to Embodiment 2.

Here, in the compressor (10) according to the present embodiment, when the rotational speed of the electric motor (40) is increased, the amount of the lubrication oil (25) that flows out to the outside of the compressor (10) increases compared with when the rotational speed is low, even if the electric valve (66*a*) is closed. Thus, as illustrated in FIG. 7A, the electric valve (66*a*) is configured such that the opening degree of the electric valve (66*a*) becomes smaller as the rotational speed of the electric motor (40) increases and the opening degree of the electric valve (66*a*) becomes larger as the rotational speed of the electric motor (40) decreases. Consequently, as illustrated in FIG. 7B, it is possible to regulate the amount of the lubrication oil (25) that flows out to the outside of the compressor (10) to be constant to some extent regardless of the rotational speed of the electric motor (40).

Feature (1) of Embodiment 2

The oil drainage mechanism (60) of the compressor (10) according to the present embodiment includes the oil drain pipe (65) having the one end (65*a*) opening in the inner wall of the casing (20) and the other end (65*b*) connected to the discharge pipe (22); and the flow-rate regulating valve (66) provided at the oil drain pipe (65).

Therefore, the lubrication oil (25) adhering to the inner wall of the casing (20) due to the swirling flow flows easily into the oil drain pipe (65) since the one end (65*a*) of the oil drain pipe (65) opens in the inner wall of the casing (20). Consequently, it is possible to cause the lubrication oil (25) to flow out easily to the outside of the compressor (10).

Feature (2) of Embodiment 2

The opening degree of the flow-rate regulating valve (66) of the compressor (10) according to the present embodiment is changeable. The opening degree decreases as the rotational speed of the electric motor (40) increases, and the opening degree increases as the rotational speed of the electric motor (40) decreases.

Therefore, it is possible to regulate the amount of the lubrication oil (25) that flows out to the outside of the compressor (10) by changing the opening degree of the flow-rate regulating valve (66) in accordance with the rotational speed of the electric motor (40).

Feature (3) of Embodiment 2

The one end (65*a*) of the oil drain pipe (65) of the compressor (10) according to the present embodiment opens in the inner wall of the casing (20) below the electric motor (40).

Therefore, it is possible to cause the lubrication oil (25) adhering to the inner wall above the electric motor (40) to flow out from the oil drain pipe (65). It is thus possible to reduce a loss of motive power due to the electric motor (40) being soaked in the lubrication oil (25).

Modification of Embodiment 2

Figure 8:
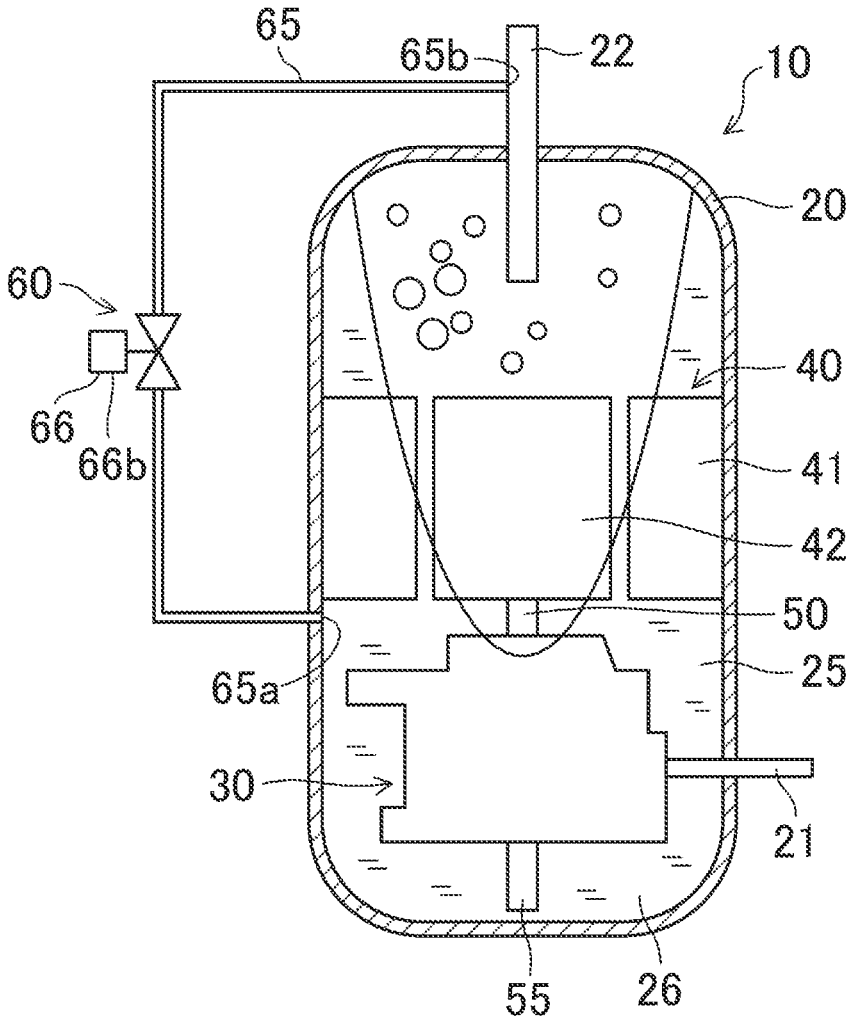
FIG. 8 corresponds to FIG. 3 and illustrates a modification of Embodiment 2.

As illustrated in FIG. 8, an electromagnetic valve (66*b*) is provided as the flow-rate regulating valve in a modification of the present embodiment. The opening degree of the electromagnetic valve (66*b*) is switchable between two steps of a large degree and a small degree. The amount of the lubrication oil (25) that passes through the valve is small with the small opening degree compared with the large opening degree. However, the flow rate of the lubrication oil that passes through the valve does not become zero even with the small opening degree.

Figure 9A:
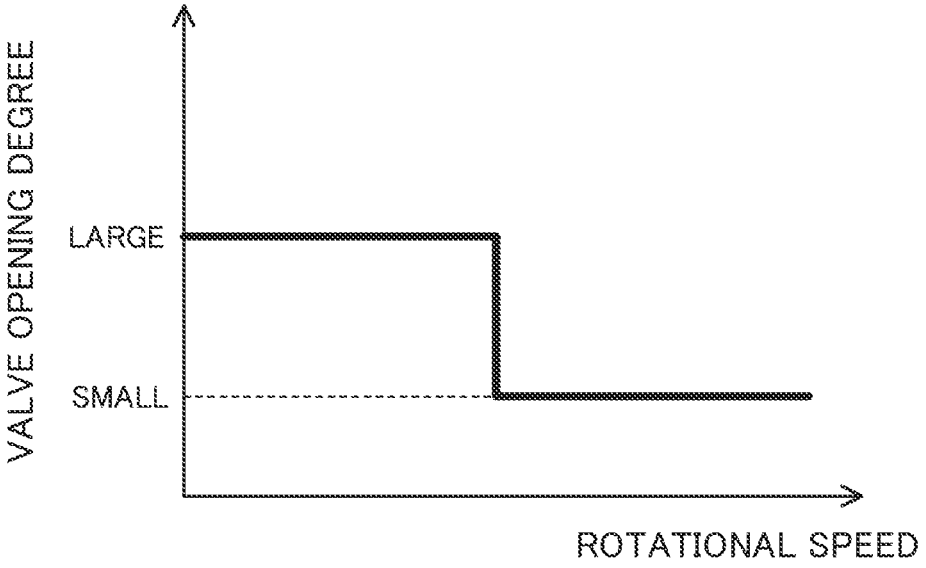
FIG. 9A is for a modification of Embodiment 2 and corresponds to FIG. 7A.
Figure 9B:
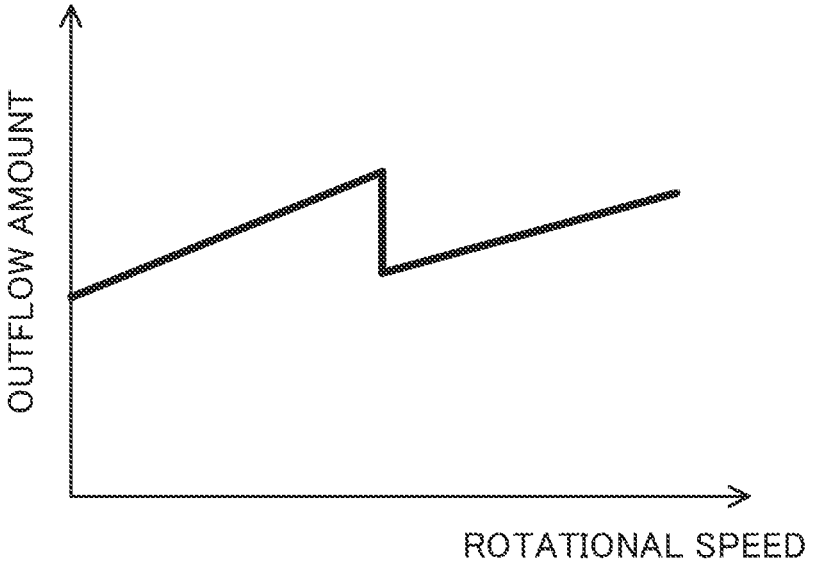
FIG. 9B is for a modification of Embodiment 2 and corresponds to FIG. 7B.

As illustrated in FIG. 9A, the electromagnetic valve (66*b*) is configured such that the electromagnetic valve (66*b*) is switched to the small opening degree when the rotational speed of the electric motor (40) is higher than a predetermined rotational speed and that the electromagnetic valve (66*b*) is switched to the large opening degree when the rotational speed of the electric motor (40) is lower than the predetermined rotational speed. Consequently, as illustrated in FIG. 9B, it is possible to regulate the amount of the lubrication oil (25) that flows out to the outside of the compressor (10) to be an appropriate amount.

Other Embodiments

The aforementioned embodiments may be configured as below.

The compressor (10) according to each of the aforementioned embodiments may be a compressor other than a rotary compressor as long as the compressor (10) is a compressor in which the electric motor (40) is disposed above the compression mechanism (30).

The discharge pipe (22) according to Embodiment 1 described above may be a curved pipe. The discharge pipe (22) does not necessarily extend through a center portion of a top portion of the casing (20) as long as the discharge pipe (22) opens in a center portion of the casing (20).

The guide surface (61*a*) of the projection (61) according to Embodiment 1 described above may be an inclined surface.

Although embodiments and modifications have been described above, it should be understood that various changes in the forms and the details are possible without departing from the gist and the scope of the claims. The above embodiments and modifications may be combined and replaced, as appropriate, as long as the directed functions of the present disclosure are not lost.

As described above, the present disclosure is useful for a compressor.

The invention claimed is:

1. A compressor comprising:

a casing configured to store a lubrication oil in a bottom portion thereof;

a compression mechanism disposed in the casing, the compression mechanism being configured to compress a sucked fluid;

an electric motor disposed above the compression mechanism, the electric motor being configured to drive the compression mechanism;

a discharge pipe arranged to open into a space in the casing on an upper side of the electric motor; and an oil drainage mechanism configured to use a swirling flow generated by a rotation of the electric motor to guide a portion of the lubrication oil adhering to an inner wall of the casing to the discharge pipe, the oil drainage mechanism including an oil drain pipe having one end that is connected to the casing so as to open through the inner wall of the casing and another end that is connected to the discharge pipe, wherein the oil drain pipe is connected to the casing at a position above the compression mechanism.

2. The compressor according to claim 1, wherein the oil drainage mechanism further includes a flow-rate regulating valve that is disposed on the oil drain pipe, the flow-rate regulating valve being configured such that an opening degree of the flow-rate regulating valve is changeable, the flow-rate regulating valve being regulated such that the opening degree decreases as a rotational speed of the electric motor increases, and the opening degree increases as the rotational speed of the electric motor decreases.

3. The compressor according to claim 2, wherein the one end of the oil drain pipe opens in the inner wall of the casing below the electric motor.

4. The compressor according to claim 1, wherein the one end of the oil drain pipe opens in the inner wall of the casing below the electric motor.

* * * * *